US005281939A

United States Patent [19]

Juds et al.

[11] Patent Number: 5,281,939

[45] Date of Patent: Jan. 25, 1994

[54] MULTIPLE POLE SOLENOID USING SIMULTANEOUSLY ENERGIZED AC AND DC COILS

[75] Inventors: Mark A. Juds, New Berlin; Bruce C. Beihoff, Wauwatosa, both of Wis.

[73] Assignee: Eaton Corporation, Cleveland, Ohio

[21] Appl. No.: 68,041

[22] Filed: May 28, 1993

[51] Int. Cl.[5] ..... H01H 7/08

[52] U.S. Cl. ..... 335/256; 335/256

[58] Field of Search ..... 335/256, 266, 254; 361/160, 194, 152, 154

[56] References Cited

U.S. PATENT DOCUMENTS

| | | | |
|---|---|---|---|
| 3,737,736 | 6/1973 | Stampfli . | |
| 4,032,823 | 6/1977 | Arvisenet et al. | 361/194 |
| 4,114,184 | 9/1978 | Stampfli | 361/154 |
| 4,166,261 | 8/1979 | Meinke et al. | 335/264 |
| 4,205,361 | 5/1980 | Shimp | 361/92 |
| 4,291,358 | 9/1981 | Dettmann et al. | 361/154 |
| 4,409,639 | 10/1983 | Wesner | 361/167 |
| 4,544,987 | 10/1985 | Loring | 361/194 |
| 4,546,955 | 10/1985 | Beyer et al. | 251/129.15 |
| 4,641,117 | 2/1987 | Willard | 335/7 |
| 4,716,490 | 12/1987 | Alexanian | 361/155 |

*Primary Examiner*—Harold Broome
*Attorney, Agent, or Firm*—L. H. Uthoff, Jr.

[57] ABSTRACT

A multiple pole solenoid (10) having outer pole flanges 44a–44d and inner pole flanges 46a–46d magnetically act on outer armature flanges (32–35) and inner armature flanges (36–39) respectively, to move an armature (14) where an AC coil (16) and a DC coil (18) are simultaneously energized by an AC electrical source (20) and a DC electrical source (22) respectively thereby providing a high pull-in force and a high holding force with low noise.

In a second embodiment, a four pole solenoid (48) is comprised of a first AC coil (62) wound on the second pole (56) and a second AC coil (64) is oppositely wound on a third pole (58) and a DC coil (66) is wound on both the second (56) and third (58) poles where the first (54) and fourth poles (60) are without coils and an armature (50) is pulled into the poles (54–60) and held in position by the simultaneous energization of both the AC coils (62,64) and the DC coil (66).

9 Claims, 3 Drawing Sheets

FIG 1
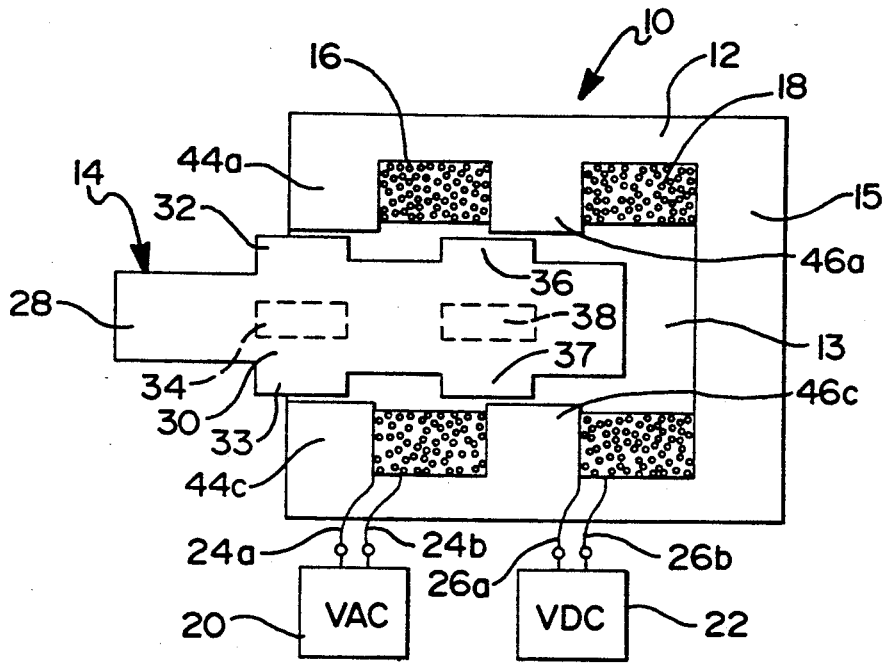
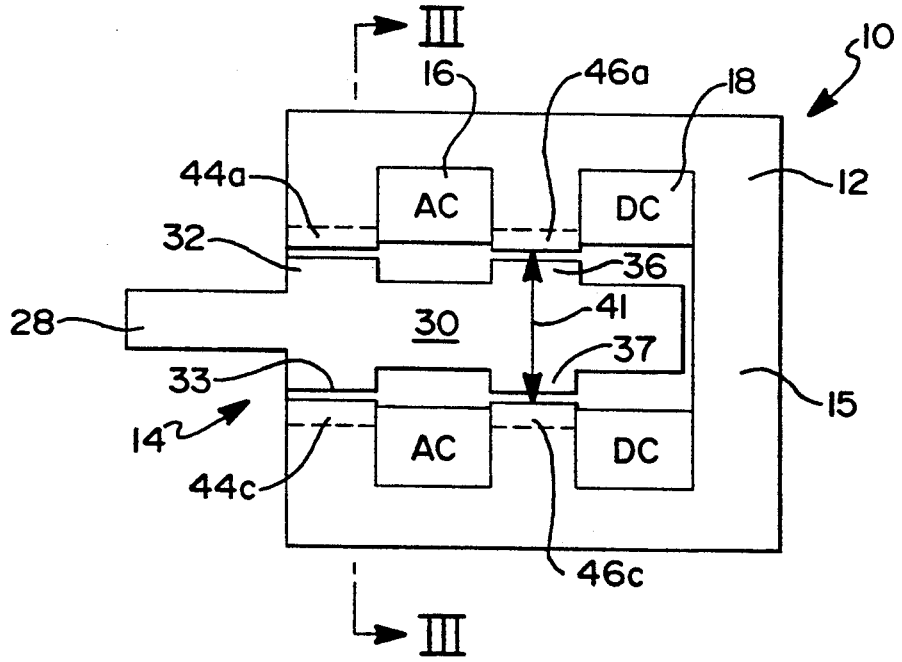
FIG 2

FIG 4
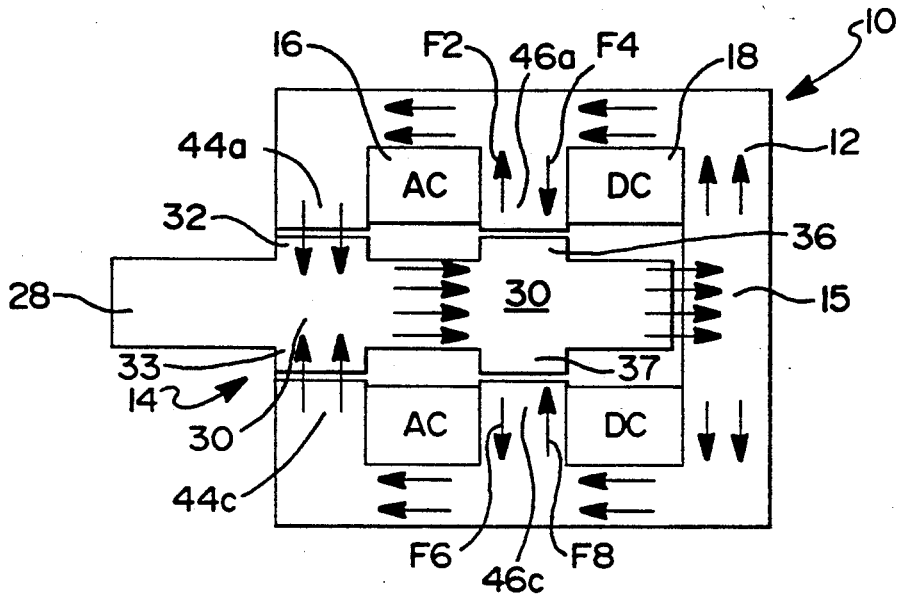
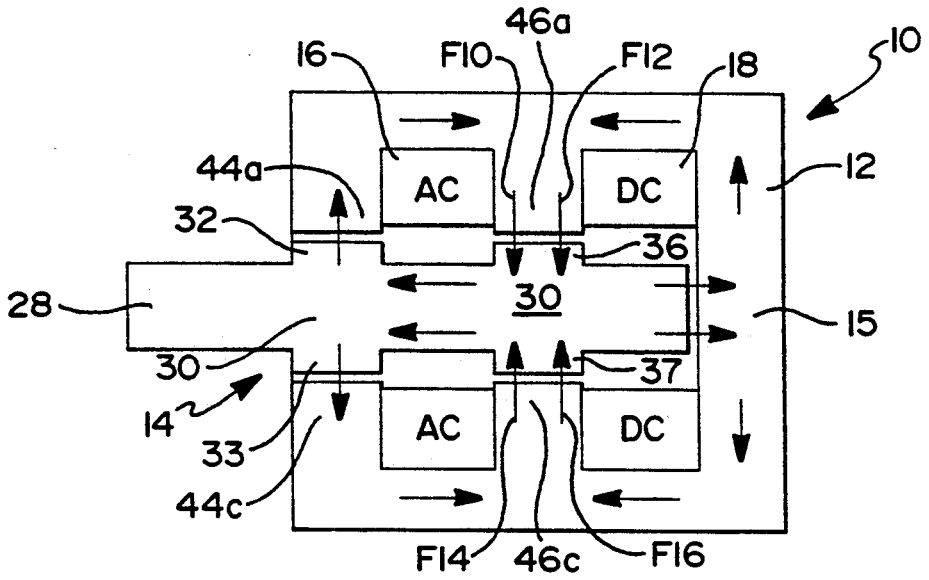
FIG 5

MULTIPLE POLE SOLENOID USING SIMULTANEOUSLY ENERGIZED AC AND DC COILS

RELATED APPLICATIONS

This application is related to application USSN Ser. No. 07/928,592 entitled "Rotary Solenoid Utilizing Continuously Energized AC and DC Coils", filed on Aug. 13, 1992 and assigned to the same assignee, Eaton Corporation, as this application.

FIELD OF THE INVENTION

The present invention relates to a solenoid actuator. More specifically, the present invention relates to a multiple pole solenoid actuator energized with simultaneous AC and DC electrical current for high pull-in and holding forces with low noise.

BACKGROUND OF THE INVENTION

Both AC and DC powered solenoids are common in the prior art and are used in a wide variety of applications requiring small control movement such as electrical contactors or fluid control valves. Either an AC or DC power supply is used to create an electromagnetic field in a core which is usually fabricated from a plurality of laminations of soft iron. The armature is attracted to the magnetic core (pole member) and provides the input force to the device that is to be controlled. The use of an AC electrical current is desirable from the standpoint that a high activation pull-in force is generated in the armature. However, upon contact with the core, the current draw of the AC winding naturally decreases because of the increased inductance. Also, the zero crossing point of the AC flux results in a high noise level due to the high frequency "buzzing" produced by the solenoid. The buzzing noise is caused by the cyclic nature of the AC current starting at zero rising to a maximum positive value and then falling through zero reaching a maximum negative value. For example, if common 60 Hz AC current is used, the buzzing would occur at this frequency due to the force reversals. Common problems with this type of AC induced noise occurs in household and office equipment and in specialized applications such as high power electrical contactors used in military equipment.

Using a DC electrical supply will solve the noise problem of the AC supply, but the level of pull-in force is dramatically reduced at a given level of supply voltage and the temperature rise is dramatically increased. Direct current (DC) solenoids do not exhibit the aforementioned buzzing noise when their motion producing elements are energized into their pull-in position. It is known to those skilled in the art that an AC energized solenoid has more pulling force at a given power level than a DC powered solenoid. Thus, if DC power is to be used, the solenoid must be considerably larger or conversely, higher DC currents must be used to generate the same pulling force as an AC coil which can result in excessive operating temperatures. Conversely, it is known that for a given size, a DC solenoid has a higher holding force at full travel than an AC solenoid along with a much lower noise level due to the non-reversing nature of the DC source.

Solenoids, such as those disclosed in U.S. Pat. Nos. 4,197,444, 4,520,332, and 3,671,899, the disclosures of which are hereby expressly incorporated by reference, use electrically energized coils to produce magnetic fields which act on a rotary or linear element to provide mechanical motion. U.S. Pat. No. 4,544,987, the disclosure of which is hereby expressly incorporated by reference, describes a magnetic switching device which uses an AC power source for energizing for activation of a switching device and subsequentially a DC current for holding the switching device in an activated position.

The referenced prior art discloses methods of using an AC supply for pull-in and then switching at the appropriate time as the armature nears the core to a DC supply generated by rectifying the AC supply. Thus, at any point in time the solenoid is powered by either AC or DC. The problem with this approach is that complicated electrical circuits must be used to both rectify the AC into DC and to perform the switching function at just the right instant of time depending on the position of the solenoid armature which requires the use of a position sensor or complicated logic contained within a smart controller. None of these devices use simultaneous continuous energization of both the AC and DC current sources for operation of the solenoid.

SUMMARY OF THE INVENTION

AC powered solenoids are, in general, more reliable than DC powered solenoids in that they do not require mechanical switching components to prevent winding burnout. In this regard, when an AC solenoid is energized, it initially draws a relatively large current which creates a large magnetic field producing a relatively large pull-in force whereby the armature of the solenoid is magnetically attracted to a pole member. However, after the armature has been moved to the pull-in position so that it is adjacent to the pole member, the current draw of the AC winding naturally decreases because of the increased inductance thereby preventing temperature buildup which can lead to coil failure. This natural phenomena of AC powered solenoids is utilized in the present invention permitting the AC energization current to supply a high level of pull-in force and yet be continuously applied even in the full travel position.

The present invention also provides a DC powered coil as a separate holding pole to be used especially for supplying a constant low noise holding force when the armature reaches the full pull-in position where the natural high holding force levels of the DC electromagnetic field are utilized to minimize buzzing of the device due to the fluctuation in the AC produced electromagnetic field which continues to be energized.

Thus, by using the present invention, the advantages of the high pull-in force of the AC induced magnetic field is utilized in conjunction to the high holding force of the DC induced magnetic field to provide a high performance, low noise, solenoid without special switching elements and with minimum size components.

A provision of the present invention is to provide a low noise multiple pole solenoid device utilizing a simultaneously AC energized coil and DC energized coil.

Another provision of the present invention is to provide a low noise multiple pole solenoid device utilizing both an AC energized coil which functions primarily for a high force solenoid pull-in and a DC energized coil which functions primarily to hold the armature in position at full travel to minimize hold-in force variation.

Another provision of the present invention is to provide a low noise multiple pole solenoid using an AC energized coil which is continuously and simultaneously energized with a DC energized coil.

Another provision of the present invention is to provide a low cost solenoid having multiple poles utilizing an AC energized coil to produce a fluctuating field through an armature and a simultaneously energized DC coil which produces an electromagnetic field that is combined with that produced by the AC energized coil to provide an enhanced, substantially constant holding force to eliminate the buzzing noise produced by the oscillation of the electromagnetic field generated by the AC energized coil.

Using the techniques taught by the present invention result in a dramatic reduction in the variation in the holding force amplitude ratio of only 1.33 to 1 as compared to a typical variation of 10 to 1 using prior art AC powered devices or, at best, a 7 to 1 variation in the minimum to maximum holding force if shaded poles are used to alter the phase of the magnetic field of the poles relative to the AC current.

BRIEF DESCRIPTION OF THE DRAWINGS

FIG. 1 is a cross-sectional view of the solenoid of the present invention;

FIG. 2 is a cross-sectional view of the armature and the pole structure of the solenoid of the present invention showing the armature fully engaged;

FIG. 4 is a cross-sectional view of the solenoid of the present invention in a fully energized state showing the lines of magnetic flux;

FIG. 5 is a cross-sectional view of the solenoid of the present invention in a fully energized state showing the lines of magnetic flux;

DETAILED DESCRIPTION OF THE PREFERRED EMBODIMENTS

Figure 3:
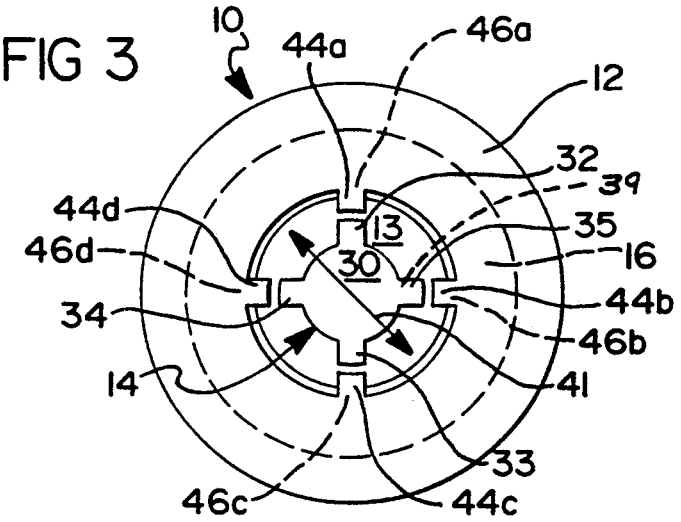
FIG. 3 is sectional view III—III of the solenoid of the present invention as shown in FIG. 2.

Referring now to the drawings, which are not intended to limit the invention, FIG. 1 illustrates the preferred embodiment of the multiple pole linear solenoid of the present invention in the general shape of a cylinder having a bore within which a rod-shaped armature is electromagnetically moved inward and mechanically moved outward. The multiple pole solenoid 10 of the present invention consists of a pole structure 12 made out of a mild steel or other magnetically conductive material which surrounds two electrical coils, the first being an AC coil 16 and the second being a DC coil 18. The AC coil 16 is electrically connected to an AC electrical source 20 and the DC coil 18 is electrically connected to a DC electrical source 22 by way of the AC connections 24*a* and 24*b* and the DC connections 26*a* and 26*b* respectively. The DC coil 18 and the AC coil 20 are typically wound out of a small gage magnet wire and are shaped as annular rings, each having an axis coincident with the axis of the cylinder bore 13 of the pole structure 12. This shape allows for the passage of a rod-shaped armature 14 to move to and fro within the inside diameter of the AC coil 16 and the DC coil 18 and also within the cylinder bore 13 formed within the pole structure 12 operating at an approximate nominal air gap of 0.010 inches as the operating clearance between the pole structure 12 and the armature 14.

The armature 14 is one piece made of a mild steel or other magnetically conductive material and is comprised of an armature extension 28 which is connected to the armature main body 30. The armature main body 30 is generally in the shape of a rod having a plurality of armature flanges 32–39 extending therefrom in a generally radial direction. The axis of the armature 14 is generally aligned with the axis of the pole structure 12 where the armature 14 moves axially to and fro within the cylindrical void 13 formed in the pole structure 12. Not shown is a plastic sleeve which lines the cylinder bore 13 and prevents the armature 14 from contacting the pole structure 12.

The plurality of armature flanges 32–39 that emanate from the armature main body 30 are comprised of two separate sets of four; a set of outer armature flanges 32–35 and a set of four inner armature flanges 36–39, as depicted in the preferred embodiment in FIG. 1. Any number of armature flanges could be used, but in the preferred embodiment, the total face area (that being the total surface of the inner armature flanges 36–39 or outer armature flanges 32–35 that face the pole structure 12) must equal the cross-sectional area of the armature 14. Also, the axial length of the inner and outer armature flanges 32–39 determine the travel of the armature 14. Thus, if a specific travel is required, the length of the inner and outer flanges 32–39 must be approximately equal to the travel. The width of the armature flanges must be sufficient to yield a total face area for each group of the inner armature flanges 32–35 and outer armature flanges 36–39 equal to the cross-sectional area of the armature 14. The group of four outer armature flanges 32–35 are equally spaced in this embodiment 90° apart and generally oriented along the major axis of the armature 14. Likewise, some distance away from the outer armature flanges 32–35 are a second group of four inner armature flanges 36–39 where inner armature flange 39 and outer armature flange 35 are not shown and are similarly oriented on the outer surface of the armature main body 30.

The pole structure 12 is generally cylinder shaped and on the inside diameter a matching opposed set of poles are formed to the inner and outer armature flanges 32–39. In this case two poles comprised of outer pole flanges 44*a*–44*d* and inner pole flanges 46*a*–46*d* are formed and having a generally cylindrical bore 13 positioned along the axis of the pole structure 12 having an inner diameter 41 with one closed end 15 thereby forming a cylinder. Both the AC coil 16 and DC coil 18 are embedded within the walls of the pole structure 12 and are separated from one another by the inner pole flanges 46*a*–46*d* and an annular ring-shaped segment of the pole structure 12. The AC coil 16 is separated from the outside of the pole structure 12 by the outer pole flanges 44*a*–44*d* and a similarly annularly shaped portion.

Thus, the first pole is formed by the outer pole flanges 44*a*–44*d*, the second pole is formed by the inner pole flanges 46*a*–46*d* and the third pole is formed by the closed end 15 of the pole structure 12.

The armature extension 28 is normally attached to an external device (not shown) whose movement is to be controlled by action of the multiple pole solenoid 10 of the present invention. Using an external force, such as a spring, the armature 14 is forced into the full pulled-out, non-energized position relative to the pole structure 12, as shown in FIG. 1. In this position, the outer armature flanges 32–35 are offset from the outer pole flanges 44*a*–44*d* and likewise, the inner armature flanges 36–39 are offset from the inner pole flanges 46a–46d. As both the AC electrical source 20 and the DC electrical source 22 are simultaneously energized, the armature 14 is pulled into the cylindrical bore 13 formed in the pole structure 12 with the AC coil 16 and the DC coil 18 contained therein, where the full pull-in energized position of the armature 14 relative to the pole structure 12 is shown in FIG. 2. The action of the armature 14 moves the external device whose motion is to be controlled in a quick and efficient manner.

The advantage to the operation of the multiple pole solenoid 10 of the present invention is its high actuation force predominately supplied by the energization of the AC coil 16 and a low noise, high holding force once the armature 14 is moved into full engagement by action of the DC coil 18 induced magnetic field. The force and current draw of the AC coil 16 decreases as the armature 14 nears the full pull-in position where the DC coil 18 takes over to supply a high holding force which interacts with the energized AC coil 16 to reduce the holding force fluctuation to only 1.3:1 as compared to 7:1 using the best prior art techniques. Both the AC coil 16 and the DC coil 18 are simultaneously energized by the AC electrical source 20 and DC electrical source 22 respectively, to provide the unique operational qualities of the present invention. Unlike the prior art, where the AC electrical source and AC coil 16 are converted to operation as a DC coil at an appropriate time as the armature nears the core by rectification of the AC electrical source which requires complicated switching and timing arrangements thereby complicating the device, the present invention produces a high pull-in force and a high holding force with low noise by simultaneously energizing both the AC coil 16 and the DC coil 18. The DC source could be rectified continuous AC.

Now referring to FIGS. 2 and 3, in FIG. 2 another cross-section view of the four pole solenoid 10 of the present invention is shown where the armature 14 is in the full pull-in energized position relative to the pole structure 12 while in FIG. 3 sectional view III—III of FIG. 2 is shown. FIG. 2 depicts the position of the armature 14 relative to the pole structure 12 when both the AC and DC electrical sources 20 and 21 respectively, are energized and holding the armature 14 in a full pull-in position thereby opposing the force generated by the external force (not shown) tending to pull the armature 14 back to the pull-out position. The outer armature flanges 32–35 are in substantial alignment with the outer pole flanges 44a and 44c and the outer pole flanges 44b and 44d (not shown) where the outer pole flanges 44a–44d form the inner diameter 41 of the cylindrical bore 13 in the pole structure 12. Also, the inner armature flanges 36–39 are in substantial alignment with the inner pole flanges 46a–46d. There is an operating air gap of approximately 0.010 inches between, for example, the outer armature flange 32 and the outer pole flange 44a. FIG. 3 clearly shows that the four outer pole flanges 44a–44d magnetically interact with the four outer armature flanges 32–35. In a like manner, the four outer pole flanges 46a–46d magnetically interact with the four inner armature flanges 36–39. As many inner and outer pole flanges and a like number of inner and outer armature flanges can be used so long as the sum of the operating air gap areas for each group of inner and outer armature flanges 32–39 is equal to the cross-sectional area of the armature 14. Also, the length and width of the pole flanges and correspondingly the armature flange can be varied to give the proper stroke of the solenoid (e.g. a long and narrow flange will produce a longer pull-in stroke with a lower pull-in force). Specifically, the first pole is defined by the outer pole flanges 44a–44d which magnetically interact with the outer armature flanges 32–35; the second pole is defined by the inner pole flanges 46a–46d which magnetically interact with the inner armature flanges 36–39; the third pole is defined by the closed end 15 which magnetically interacts with the armature main body 30.

More specifically, FIG. 3 shows an end view of the four pole solenoid 10 of the present invention where the four outer armature flanges 32–35 are more clearly shown as they are formed on the outer surface of the armature 14 and radially equally spaced at 90° separation angle. Not shown are the inner armature flanges 36–39 which are similarly attached to the armature 14 in a radial orientation and similarly separated by an angle of 90°. All four outer armature flanges 32–35 are in close proximity to the cylindrical pole inner diameter 41 which establishes what is commonly referred to as the operating air gap which is selected to be approximately 0.010 inches. Also shown is the AC coil 16 mounted within the pole structure 12, thereby providing for the establishment of an electromagnetic field within both the pole structure 12 and the armature 14 upon introduction of an AC electrical current as supplied by the AC source 20. The pole structure 12 surrounds a cylindrical bore 13 which is closed by one closed end 15 and constructed of a mild steel or other magnetically conducting material. In the pole structure 12 is mounted the AC coil 16 and the DC coil 18 (not shown). The armature main body 30 does not contact the pole structure 12 but rather has an operating air gap of approximately 0.010 inches where the armature 14 and the pole structure 12 are separated by a plastic or non-magnetic sleeve (not shown) where the outer annular flanges 32–35 or the inner annular flanges 36–39 (not shown) do not contact the cylindrical pole inner diameter 41. The armature 14 thus moves in an axial direction in and out of the pole structure 12 upon energization of either the AC coil 16 or the DC coil 18, although using the teaching of the present invention both the AC coil 16 and the DC coil 18 are simultaneously energized. The armature 14 is drawn inward by the electromagnetic fields in the pole structure 12 established by the coils 16 and 18 and upon de-energization of the AC coil 16 and the DC coil 18 are mechanically returned to the state as shown in FIG. 1 by a mechanical method such as a spring either mounted on the multiple pole solenoid 10 of the present invention or on the external device whose position is to be controlled.

Now referring to FIGS. 4 and 5, the multiple pole solenoid 10 of the present invention is shown where the lines of magnetic flux produced by the AC coil 16 and the DC coil 18 are shown by way of a multiplicity of arrows which signify the direction of the flux when the AC coil 16 reacts with the magnetics generated by the DC coil 18. FIGS. 4 and 5 illustrate the direction and relative amplitude of the electromagnetic fields induced in both the pole structure 12 and the armature 14 as the AC coil 16 and DC coil 18 are energized especially to illustrate the condition where the AC coil 16 reverses its electromagnetic field as the exciting current from the AC electrical source 20 changes phase going from a plus AC to a minus AC typically at a frequency of 60 Hertz. FIGS. 4 and 5 also illustrate the fluctuation in the electromagnetic holding force due to the alternating nature of the AC electrical source 20 where the holding forces are summarized in Table I infra and are discussed in more detail in following sections. Generally speaking, the larger the clearance between the armature 14 and the pole structure 12 the lower the actuation and holding force of the four pole solenoid 10 of the present invention at a given level of AC and DC excitation current. Thus, it is desirable to minimize the operating air gaps through various known means of positioning the armature 14 relative to the pole structure 12, in this case using a plastic or non-magnetic sleeve between the two elements.

Specifically, FIGS. 4 and 5 depict in cross-sectional views of the multiple pole solenoid 10 when the magnetic flux, indicated by the arrows, produced by the AC coil 16 is additive in some directions and counteracts that produced by the DC coil 18 in other directions. In FIG. 4, the AC magnetic flux can be considered moving in a positive direction where generally the magnetic flux present in the multiple pole solenoid 10 is produced by the addition of the flux produced by the AC coil 16 to that of the flux produced by the DC coil 18 except in the region of the inner pole flanges 46*a*–46*d* where the flux F2 and flux F6 generated by the AC coil 16 is respectfully opposite in direction to the flux F4 and F8 generated by the DC coil 18 and the two flux pairs F2, F4 and F6, F8 generally negate one another. All of the other flux patterns from the AC coil 16 and the DC coil 18 are additive.

Now referring to FIG. 5, the direction of the AC current is changed by a phase shift of 180° in the AC coil as compared to that in FIG. 4 and the magnetic flux F10 and flux F14 generated by the AC coil 16 now add to the flux generated by the DC coil 18 in the region of the inner pole flanges 46*a*–46*d* where the flux F10 and flux F12 and flux F14 and flux F16 are additive. Even though a large portion of the flux produced by the AC coil 16 and the DC coil 18 are opposing one another, the total variation in the force on the armature 14 only varies by 33% (for FIG. 6 as shown in Table I) when the AC flux changes phase.

Thus, by using a simultaneously energized AC coil 16 and DC coil 18, the overall force imparted to the armature 14 is at a more constant level at pull-in than would be realized if the AC coil 16 were energized without benefit of the DC coil 18. Also, no rectification and complicated switching of the AC source 20 to supply a holding force is needed when using the teaching of the present invention. Thus, the overall size and complexity of the multiple pole solenoid 10 is reduced as compared to prior art solenoids with the same level of performance by simultaneously energizing both the AC coil 16 and the DC coil 18. The AC coil 16 provides the majority of the force to initially move the armature 14 toward the full pull-in position which then mutually decreases in amplitude due to the increased inductance as the armature 14 approaches the end of its travel. Upon movement of the armature 14 into the pole structure 12, the electromagnetic force produced by DC coil 18 provides for a very steady and low noise holding force thereby providing quiet operation and enhanced performance without the complexity of rectifying and switching the AC electrical source 20. (The variation of the force on the armature 14 using the alternate embodiment of the present invention is explained by way of reference to Table I in the following section of this disclosure).

Figure 6:
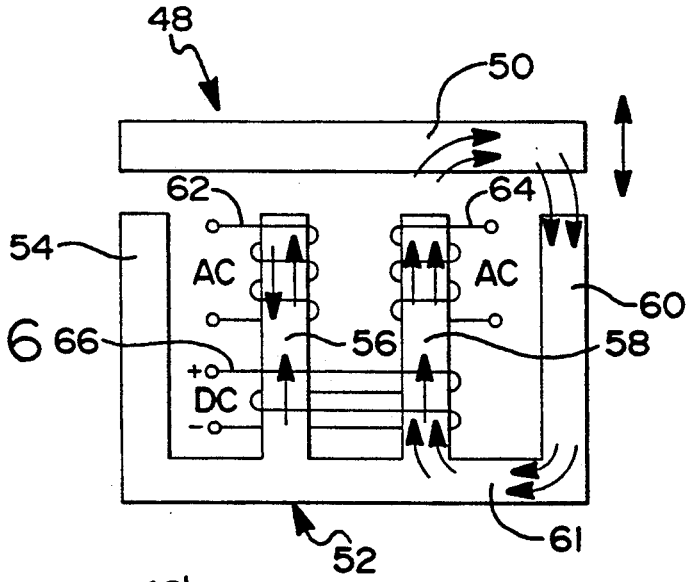
FIG. 6 is a cross-sectional view of an alternate embodiment of the present invention.

An alternate embodiment of the present invention is shown in FIG. 6 which serves to more clearly illustrate the use of, in this case, four poles in an electrical magnetic device such as a solenoid. The four pole solenoid 48 of the present invention consists of the following basic elements: a pole structure 52, an armature 50 which axially moves in relation to the pole structure 52, and a pair of oppositely wound AC coils 62,64, and a DC coil 66. The pole structure 52 consists of a first pole 54 and a second pole 56 and a third pole 58 and a fourth pole 60 where the first, second, third, and fourth poles 54 through 60 are substantially parallel, one to the other, and carry an electromagnetic field produced by the three coils 62,64 and 66 respectively, and are mechanically joined together by the base plate 61.

The three coils are made up of two alternating current powered AC coils 62 and 64 where AC coil 62 is wound around the second pole 56 and a second alternating current powered AC coil 64 is wound in an opposite direction to that of the first AC coil 62 around the third pole 58. To complete the structure, a DC coil 66 is wound around in combination the second pole 56 and the third pole 58 and then connected to a DC electrical source 22. The first AC coil 62 is connected to the AC electrical source 20 and the second AC coil 64 is also connected to the same AC electrical source 20. However, since the AC coils 62 and 64 are wound on their respective poles in opposite directions, the magnetic fields produced are equal in magnitude but in opposite phase. As the first AC coil 62, the second AC coil 64 and the DC coil 66 are simultaneously energized, the armature 50 is forced toward the pole 52 such that the four pole solenoid 48 of the present invention functions in a similar manner to the multiple pole solenoid 10 of the present invention. Again, in a similar manner, the fluctuation of the force on the armature 50 is dramatically reduced along with a high pull-in force exerted during the initial movement of the armature 50 due to simultaneous energization of the first AC coil 62, second AC coil 64, and the DC coil 66. The coils 62,64 and 66 together act on the armature 50 to provide for a very high actuation force and a very high seal force with low noise due to the reduction in the variation in the sealing force as best illustrated by reference to Table I. No switching or rectification of the AC electrical source 20 is required due to the fact that separate AC and DC coils and power supplies are utilized to provide the electromagnetic force in the actuator.

The result is an electromagnetic device which functions to have high force characteristics with low noise due to the use of two AC coils 62 and 64 which combine to produce a high pull-in force. A relatively high constant holding force, which combines with the force produced by the AC coils 62 and 64, is produced by the DC coil 66. According to the present invention, the AC coils 62 and 64 and the DC coil 66 are simultaneously connected and energized by the AC source 20 and the DC source 22 respectively.

The primary advantages of the present invention over an AC magnet of the same volume include a high, relatively constant sealing force which leads to quiet operation with very low power dissipation at full pull-in. Advantages over a DC magnet include a long stroke with a high pull-in force at equal current levels. Due to the nature of the AC powered electromagnet, the current draw is automatically reduced as the armature 50 comes in close proximity to the pole 52 whereupon the DC electromagnet takes over.

The figures shown in Table I clearly illustrate the operational advantages of the present invention. The first column shows a series of time steps based on the frequency of the alternating current, where times steps 1–9 are required to complete one full cycle of the alternating current (e.g. at 60 Hz, each step would represent approximately 0.002 of a second). In the second column, the relative current flowing in the AC and DC coils is shown at any point in time during one cycle of the AC current where an arbitrary amplitude from zero to one is used for both the AC and DC coils. It is easily seen that the amplitude of the current flowing in the AC coils increases and decreases out of phase to an equal amplitude, since they are wound in opposite directions. The current flowing in the DC coil remains constant and at a relative amplitude of 1. In the third column the relative flux densities in each of the first, second, third, and fourth poles 54,56,58, and 60 are shown as $\phi 1$, $\phi 2$, $\phi 3$, and $\phi 4$ respectively, where the relative flux density is determined by considering the relative current flow in each of the AC and DC coils. The net force exerted on the armature 50 is shown in the fourth column which is expressed in arbitrary units where the net force varies throughout the actuation cycle from 3.0 to a maximum of 4.0 thereby illustrating the relatively constant level of holding force as compared to the prior art. Prior art devices commonly vary in holding force from a minimum to maximum level of 7 to 1 using the latest shaded pole technology and 20 to 1 for conventional solenoid structures.

TABLE I

| 1 Time Steps | 2 Relative Coil Current (amps) AC1 | AC2 | DC | 3 Relative Flux Density In Each Pole $\phi 1$ | $\phi 2$ | $\phi 3$ | $\phi 4$ | 4 Net Armature Force |
|---|---|---|---|---|---|---|---|---|
| 1 | 0 | 0 | 1 | −1 | 1 | 1 | −1 | 3.0 |
| 2 | .7 | −.7 | 1 | −1 | 1.7 | .3 | −1 | 3.5 |
| 3 | 1 | −1 | 1 | −1 | 2 | 0 | −1 | 4.0 |
| 4 | .7 | −.7 | 1 | −1 | 1.7 | .3 | −1 | 3.5 |
| 5 | 0 | 0 | 1 | −1 | 1 | 1 | −1 | 3.0 |
| 6 | −.7 | .7 | 1 | −1 | .3 | 1.7 | −1 | 3.5 |
| 7 | −1 | 1 | 1 | −1 | 0 | 2 | −1 | 4.0 |
| 8 | −.7 | .7 | 1 | −1 | .3 | 1.7 | −1 | 3.5 |
| 9 | 0 | 0 | 1 | −1 | 1 | 1 | −1 | 3.0 |

Figure 7:
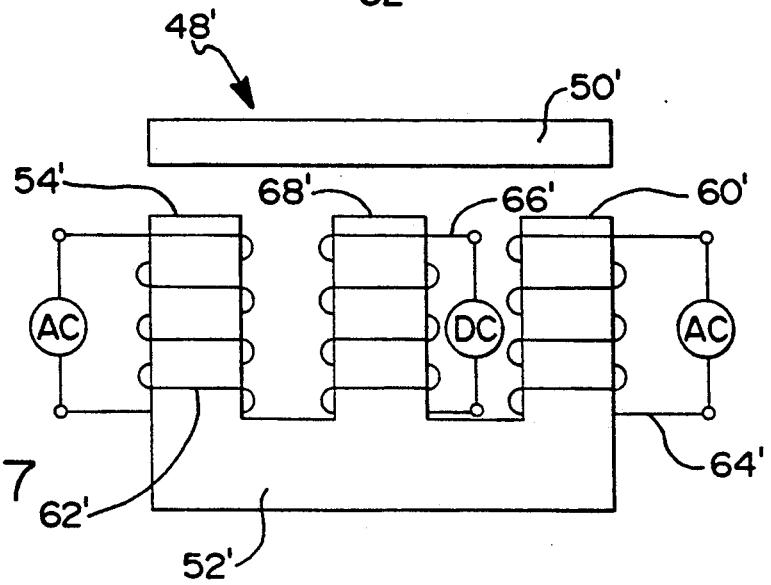
FIG. 7 is a cross-sectional view of a second alternate embodiment of the present invention.

In a second alternate embodiment 48' of the present invention as shown in FIG. 7, the second pole 56 and third pole 58 of FIG. 6 are combined to form a center pole 68'. An AC coil 62' is wound around the first pole 54' and a second AC coil 64' is wound around the second pole 60' in a direction to produce a magnetic field acting on the armature 50' opposite to that produced by the AC coil 62'. A DC coil 66' is wound around the center pole 68'. Again, the AC coils 62' and 64' and the DC coil 66' are simultaneously energized and the resulting magnetic fields interact to produce a solenoid with improved performance. The first pole 54', the center pole 68' and the second pole 60' are joined structurally and magnetically by the base 52'.

From the foregoing, it should be apparent that a new and improved multiple pole solenoid has been provided which utilizes a simultaneously energized AC winding and DC winding for supplying a high actuation and holding force with low noise and low power dissipation in a compact lightweight assembly. Although the present invention has been herein above been described with respect to the illustrated embodiments, it will be understood that the invention is capable of modification and variation, which will be encompassed by the scope of the following claims.

We claim:

1. A solenoid actuator comprising:

an AC source of alternating current electrical power;

a DC source of direct current electrical power;

a magnetic pole structure comprised of a plurality of poles, said poles magnetically joined one to the other;

a first AC coil wound around a first pole of said plurality of poles and electrically connected to said AC source;

a second AC coil wound around a second pole of said plurality of poles where said second AC coil is wound to induce a magnetic field opposite in direction to that induced by said first AC coil;

a DC coil formed by winding around the combination of said first pole and said second pole;

a magnetic armature arranged to be magnetically attached and moved upon energization of said first AC coil and said second AC coil and said DC coil by said AC source and said DC source;

where said first AC coil and said second AC coil and said DC coil are simultaneously energized by said AC source and said DC source respectively.

2. The solenoid actuator as defined in claim 1, wherein said plurality of poles is comprised of said first pole and said second pole and a third pole and a fourth pole where said third pole and said fourth pole provide a magnetic path for conduction of the magnetic field generated in said first pole and said second pole by said first AC coil and said second AC coil and said DC coil.

3. The solenoid actuator as defined in claim 2, wherein said third pole and said fourth pole are geometrically positioned to the outside of said first pole and second pole respectively.

4. The solenoid actuator as defined in claim 2, wherein said first pole and said second pole and said third pole and said fourth pole are substantially parallel.

5. The solenoid actuator as defined in claim 4, wherein said first pole has a first end and a second end, said second pole has a first end and a second end, said third pole has a first end and a second end, said fourth pole has a first end and a second end, where said first ends contact said armature and said second ends are mechanically joined.

6. A solenoid actuator comprising:

an AC source of alternating current electrical power;

a DC source of direct current electrical power;

a magnetic pole structure having a cylindrical shape closed at a first end and open at a second end having a cylindrical bore found therein where the longitudinal axis of said cylindrical bore is coincident with the longitudinal axis of said pole structure;

a cylindrical magnetic armature residing within said cylindrical bore and moveable with respect to said cylindrical bore;

an AC coil comprising a multiplicity of turns of electrical wire connected to said AC source where said AC coil is shaped as an annular ring having an axis coincident with said axis of said cylindrical bore and an inside diameter sufficient to allow said armature to move with respect to said AC coil and mounted within said pole structure;

a DC coil comprising a multiplicity of turns of electrical wire connected to said DC source where said DC coil is shaped as an annular ring mounted within said pole structure parallel and axially displaced relative to said AC coil and having an axis coincident to said AC coil axis;

where both said AC coil and said DC coil are simultaneously energized by said AC source and said DC source respectively.

7. The solenoid actuator as defined in claim 6, wherein said armature further comprises a plurality of armature flanges radially extending from said armature in relatively close proximity to said pole structure.

8. The solenoid actuator as defined in claim 7, wherein said plurality of armature flanges are comprised of a plurality of outer armature flanges and a plurality of inner armature flanges where said outer armature flanges are separated by an approximate equal angle between adjacent flanges and where said inner armature flanges are separated by an approximate equal angle between adjacent flanges.

9. The solenoid actuator as defined in claim 7, wherein said plurality of outer armature flanges are in substantial alignment with a like plurality pole flanges formed in said pole structure disposed between said open end and said AC coil and where said plurality of said inner armature flanges are in substantial alignment with a like plurality of pole flanges formed in said pole structure disposed between said AC coil and said DC coil.

* * * * *